US006471376B1

(12) United States Patent
Tschetter et al.

(10) Patent No.: US 6,471,376 B1
(45) Date of Patent: Oct. 29, 2002

(54) INCREASED LIFE REFLECTOR LAMPS

(75) Inventors: Charles D. Tschetter, Mayfield Village; Rajasingh Israel, Westlake; Carl Gunter, Twinsburg, all of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/641,262

(22) Filed: Aug. 17, 2000

(51) Int. Cl.[7] ..... F21V 7/00
(52) U.S. Cl. ..... 362/296; 362/341; 362/327
(58) Field of Search ..... 362/296, 341, 362/327; 313/113

(56) References Cited

U.S. PATENT DOCUMENTS 4,833,576 A 5/1989 Mers et al.
5,143,445 A 9/1992 Bateman et al.
5,493,170 A * 2/1996 Sheppard et al. ..... 313/113
5,569,970 A 10/1996 Dynys et al.
5,646,473 A * 7/1997 Egglink et al. ..... 313/113
6,323,601 B1 * 11/2001 Klein et al. ..... 315/248

* cited by examiner

*Primary Examiner*—Sandra O'Shea
*Assistant Examiner*—Ronald E. DelGizzi
(74) *Attorney, Agent, or Firm*—Fay, Sharpe, Fagan, Minnich & McKee, LLP

(57) ABSTRACT

A light source comprising a light generating element and a reflector, said reflector comprised of a generally parabolic shaped body including an at least substantially closed end and an open end, the light source disposed generally adjacent said closed end, said reflector including a light reflecting coating on both an internal and an external surface of said body, wherein a portion of said external surface of said body adjacent the closed end of the reflector is substantially devoid of said coating.

14 Claims, 1 Drawing Sheet

INCREASED LIFE REFLECTOR LAMPS

BACKGROUND OF THE INVENTION

The present invention relates generally to lighting, and more particularly to reflector lamps including an optical interference filter to tailor the transmitted light energy.

Thin film optical interference coatings, known as interference filters or optical interference films, which comprise alternating layers of two or more materials of different refractive index are well known to those skilled in the art. Such coatings or films are used to selectively reflect and/or transmit light radiation from various portions of the electromagnetic spectrum such as ultraviolet, visible and infrared radiation. These films or coatings are used in the lamp industry to coat reflectors and lamp envelopes.

One application in which these coatings have been found to be useful is applied to reflectors in the form of what is known in the art as cold mirrors. A cold mirror is a glass or plastic reflector coated on the inside reflecting surface with an optical filter which reflects visible light, thereby projecting it forward of the reflector, while at the same time permitting longer wavelength infrared energy to pass through the coating and the reflector. This insures that the light projected forward by the reflector is cooler than it would otherwise be if both the visible and the infrared light were reflected and projected forward.

Multi-layer optical inference filters and their use with reflector electric lamps is well known to those skilled in the art. Commercially available, high efficiency lamps including an optical interference filter have achieved considerable commercial success such as the Halogen-IR available from General Electric Company. This lamp includes a double ended light source (such as a halogen-incandescent lamp) mounted inside a parabolic reflector.

Optical interference filters are often made of alternating layers of refractory metal oxides having high and low indexes of refraction. Refractory metal oxides are used because they are able to withstand the relatively high temperatures (e.g 400° C. to 900° C.) that develop during lamp operation. Such oxides include, for example, titania, hafnia, tantala and niobia for the high index of refraction material and silica or magnesium fluoride for the low index of refraction materials. Examples of these types of filters are provided in U.S. Pat. Nos. 5,143,445 and 5,569,970, herein incorporated by reference, wherein these materials provide high reflectance in the visible spectrum between, for example, 380 to 770 nanometers.

Typically, cold mirror coatings are based on combining two or more reflectance arrays. A high reflectance array consists of alternating layers of high and low index films, each layer having an optical thickness of one Quarter-Wave Optical Thickness (QWOT). The optical thickness is defined as the product of the physical thickness times the refractive index of the film. The QWOT is referenced to a conveniently chosen design wavelength. For example, at a design wavelength of 500 nm, a QWOT equals 125 nm. Since a single high reflectance array reflects across only a portion of the visible region, two or more arrays must be combined for an extended high reflectance band across the visible spectrum.

Cold mirror reflectors have achieved a high degree of acceptance in display lighting applications where their high degree of reflectance of visible light of the proper color temperature has been found very attractive. Therefore, a combination of high visible reflectance, good color maintenance over the life of the reflector, and the ability to select varying degrees of infrared and ultraviolet reduction have emerged as important factors in lighting coatings.

The subject invention is provided to minimize the temperature in the vicinity of the lamp, helping to reduce oxidation and other physical degradation thereof.

BRIEF SUMMARY OF THE INVENTION

According to an exemplary process for manufacture of the invention, a reflector for a lamp comprised of a body having a generally parabolic shape is coated on its interior and exterior surfaces with a light reflective coating. Preferably, chemical vapor deposition is utilized for the coating process. Thereafter, the coating on the external surface adjacent a cavity in the closed end of the reflector body is removed.

Exemplary embodiments of the invention can be used to improve the performance in various types of reflector lamps including arc discharge lamps, incandescent lamps and halogen lamps. In this regard, the invention is also directed to the reflector formed via the inventive process. Moreover, the reflector is generally a parabolic shaped body including one generally closed end and an opposed open end. The closed end includes a cavity housing the base of the lamp. Electrical connections are provided through the closed end of the reflector and the lamp cemented therein. A light reflecting coating is included on both the internal and external surfaces of the reflector body. However, the external surface of the reflector body adjacent the cavity is substantially devoid of the coating.

BRIEF DESCRIPTION OF THE DRAWINGS

Other features and advantages of the invention will be more readily understood upon reading the following detailed description, in conjunction with the drawings in which.

DETAILED DESCRIPTION OF THE INVENTION

This invention relates to a reflector coated on both sides with an optical interference film. More particularly this invention relates to a glass or plastic reflector and its use with lamps, wherein both the inside and the outside surfaces of the reflector are coated with an optical interference film, preferably, deposited by a low pressure chemical vapor deposition process.

Figure 1:
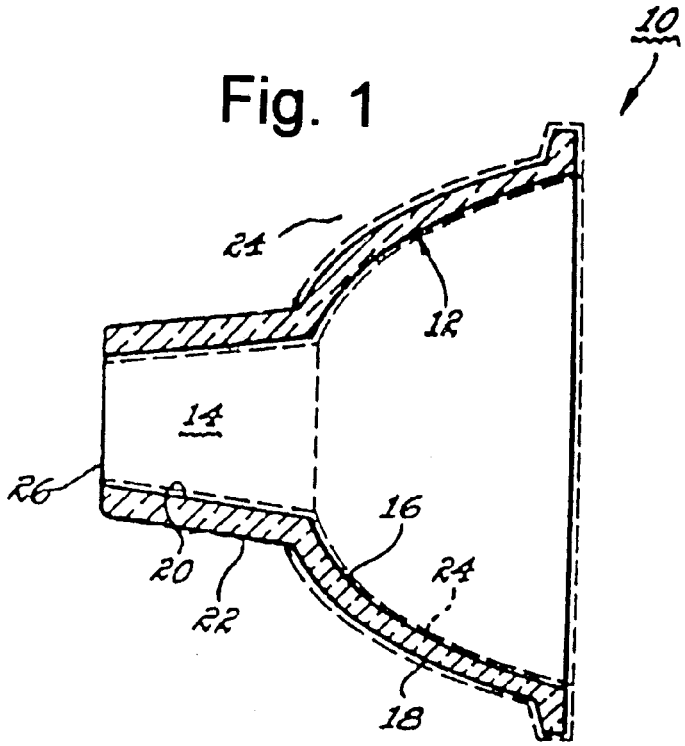
FIG. 1 illustrates the reflector of the present invention.

FIG. 1 schematically illustrates an all glass reflector 10 having a parabolic reflecting portion 12 at one end with the other end terminating in an elongated cavity portion 14 for receiving a lamp. The parabolic reflecting portion has internal and external surfaces 16 and 18, respectively, and the elongated rear portion has an internal surface 20 defining a cavity therein, an external surface 22 and an end surface 26. Traditionally, all surfaces of the reflector 10 have been coated with the reflective film (see U.S. Pat. No. 5,143,455).

Figure 2:
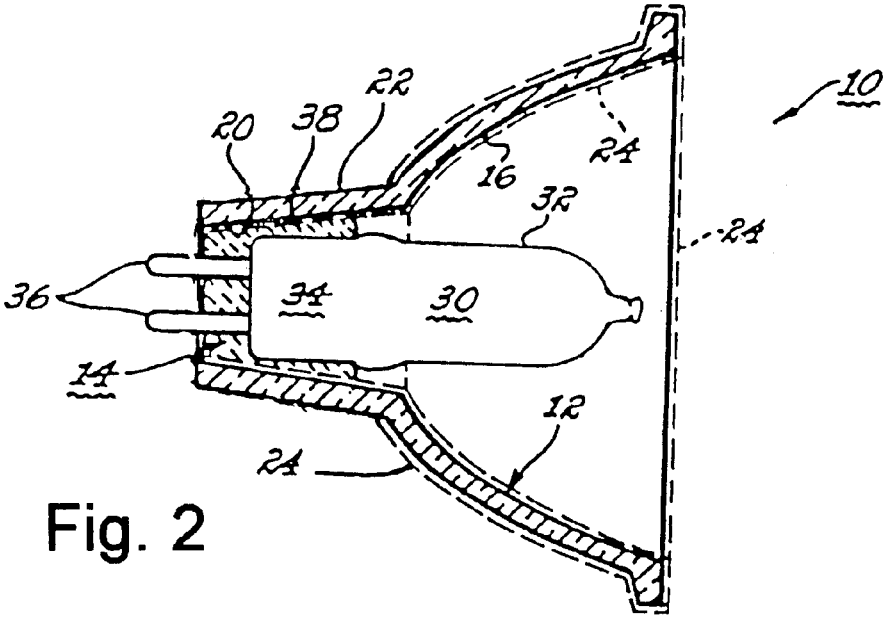
FIG. 2 illustrates the reflector lamp of the present invention.

It has now been found that coating the exterior surface 22 of cavity 14 can result in too much heat build up in the cavity which can crack the reflector and also cause lamp failure due to oxidation of lamp leads cemented in the cavity (see, FIG. 2).

Thus, in the present invention, both the internal and external surfaces 16 and 18, respectively, of parabolic reflecting portion 12 are coated with an optical interference film 24. The film 24 is also uniform and continuous over interior surface 20 of cavity 14. However, exterior surface 22, and optically end 26, adjacent cavity 14 do not include the coating. In this manner, heat dissipation in the end region of the lamp is improved and the temperature in the seal region of the lamp is reduced.

Turning now to FIG. 2, there is schematically illustrated lamp 30 comprising a vitreous envelope 32 hermetically sealed at 34 by means of a customary pinch seal or shrink seal and having exterior leads 36, wherein said lamp is cemented into cavity 14 by cement 38. Lamp and reflector combinations of this type, but having an optical interference coating only on the interior reflecting surface, are known to those skilled in the art, as are suitable cements for securing the lamp in the reflector. U.S. Pat. No. 4,833,576, which is incorporated herein by reference, discloses such lamp and reflector combinations and cement for cementing the lamp in the reflector which are useful in the practice of the present invention. It should be noted that the lead assembly of a lamp is a point at which a large percentage of failure occurs. Moreover, the complexity of the lead pinch seal arrangement is more prone to degradation than the remainder of the lamp. Unfortunately, this area, disposed in cement, is often exposed to high temperature cycling.

Lamp 30 also contains a filament and inleads within envelope 32. When energized, lamp 30 emits light, most of the visible of which is reflected by coating 24 on the interior surface 16 of parabolic reflecting portion 12. In the embodiment shown in FIG. 2, all of the surfaces interior and exterior of reflector 10, with the exception of the exterior surface 22 of adjacent cavity 14 are coated with the optical interference coating which transmits infrared radiation and reflects visible light.

It has been found that two sided coating causes the nose temperature of the reflectors to increase slightly. Dropping the cavity temperature allows the seal 34 temperature of the filament tube in the lamp to operate cooler than normal, which will produces a significant benefit primarily in the form of longer lamp life.

According to one embodiment of the invention, a traditional LPCVD coating of the reflector body 10 can be performed, and thereafter, sand blasting used to remove the reflective coating on the outside of the reflector on surface 22. Sand blasting is particularly preferred, but not the exclusive technique for coating removal, because it roughens the surface of the glass on the outside of the reflector nose, increasing the surface area and the ability of the reflector body to dissipate thermal radiation. It has been demonstrated that sand blasting of the reflective coating from the outer nose of a reflector dropped the nose temperature of the lamp contain within the reflector by up to nearly 10° C.

The subject invention is suitable for use in association with an incandescent lamp, an arc discharge lamp or a halogen lamp. In addition to the use of sand blasting, chemical etching can be utilized to achieve the removal of the coating in the appropriate location. Chemical etching and sand blasting can be achieved via the precision application of the medium via equipment and techniques known to those of ordinary skill in the art and/or via the inclusion of masking of the area in which the coating is to be retained. Of course, the LPCVD process could also be designed to prevent coating of surface 22, then physically treated to roughen it, if desired.

Although the invention has been described with reference to exemplary embodiments) various changes and modifications can be made without departing from the scope and spirit of the invention. For example, the above described technique can be applied to other shaped reflectors than shown in FIG. 1 to achieve the same beneficial results. These and other modifications are intended to fall within the scope of the invention as defined by the following claims.

What is claimed is:

1. A light source comprising a light generating element and a reflector, said reflector comprised of a generally parabolic shaped body for reflecting light forward and a rearwardly projecting member having side walls and an end opposite said parabolic shaped body, said member forming an elongated cavity, the light generating element having a first end disposed within said cavity, said reflector including a light reflecting coating on both an internal and an external surface of said body, the light source having the light reflecting coating on an external surface of said side walls substantially removed by sand blasting.

2. The light source of claim 1 wherein said light generating element is selected from the group consisting of incandescent lamps, arc discharge lamps or halogen lamps.

3. The light source of claim 1 wherein said light generating element is a halogen lamp.

4. The light source of claim 1 wherein said coating is comprised of layers of high and low index of refraction oxide materials.

5. The light source of claim 4 wherein said high refraction index material is comprised of tantalum or titanium oxides.

6. The light source of claim 4 wherein said low refraction index material is comprised of silicon oxide.

7. The light source of claim 1 wherein said external surface of said cavity has a higher surface roughness than the external surface of said body.

8. The light source of claim 1 having an increased surface roughness.

9. The light source of claim 1 wherein said cavity includes an inner surface having a light reflective coating.

10. The light source of claim 1 wherein said light generating element is cemented into said cavity.

11. A method of manufacturing a reflector for a lamp comprising coating the internal and external surfaces of a generally parabolic shaped body having a rearwardly protruding member including side walls and an end opposite said parabolic shaped body, said member forming a cavity, with a light reflecting coating via chemical vapor deposition, and treating the external surface of the side walls to remove the reflective coating.

12. The method of claim 11 wherein said treating comprises sand blasting or chemical etching.

13. The method of claim 11 wherein said treating comprises sand blasting.

14. A method of manufacturing a reflector for a lamp comprising coating the internal and external surfaces of a generally parabolic shaped body having a rearwardly protruding member including side walls and an end opposite said parabolic shaped body, said member forming a cavity, with a light reflecting coating via chemical vapor deposition, wherein the external surface of the side walls are masked during said chemical vapor deposition.

* * * * *